US010748723B2

(12) United States Patent
Jaenicke

(10) Patent No.: US 10,748,723 B2
(45) Date of Patent: Aug. 18, 2020

(54) VACUUM SWITCH

(71) Applicant: SIEMENS AKTIENGESELLSCHAFT, Munich (DE)

(72) Inventor: Lutz-Ruediger Jaenicke, Mahlow (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/335,810

(22) PCT Filed: Sep. 5, 2017

(86) PCT No.: PCT/EP2017/072178
§ 371 (c)(1),
(2) Date: Mar. 22, 2019

(87) PCT Pub. No.: WO2018/054677
PCT Pub. Date: Mar. 29, 2018

(65) Prior Publication Data

US 2019/0228935 A1 Jul. 25, 2019

(30) Foreign Application Priority Data

Sep. 23, 2016 (DE) ..... 10 2016 218 316

(51) Int. Cl.
*H01H 33/662* (2006.01)
*H01H 33/56* (2006.01)

(52) U.S. Cl.
CPC ..... *H01H 33/66207* (2013.01); *H01H 33/56* (2013.01); *H01H 33/66238* (2013.01); *H01H 2033/6623* (2013.01)

(58) Field of Classification Search
CPC ..... H01H 33/66207; H01H 33/66238; H01H 33/662; H01H 33/56; H01H 2033/6623;
(Continued)

(56) References Cited

U.S. PATENT DOCUMENTS 4,158,911 A * 6/1979 Polinko, Jr. ..... H01H 11/00 218/121
4,434,331 A 2/1984 Sakuma et al.
(Continued)

FOREIGN PATENT DOCUMENTS

CN 101106034 A 1/2008
CN 202034299 U 11/2011
(Continued)

OTHER PUBLICATIONS

Reig Perez et al.: "Electric and thermal insulation of superconducting busbar for aviation use" Universitat Politecnica de Valencia, Apr. 30, 2013, pp. 1-4, XP055325679.

*Primary Examiner* — William A Bolton
(74) *Attorney, Agent, or Firm* — Laurence Greenberg; Werner Stemer; Ralph Locher

(57) ABSTRACT

A vacuum switch includes two mutually spaced apart bases and a vacuum interrupter disposed between the bases and connected to the bases. A first switching element is disposed in the vacuum interrupter. A second switching element is movable between a first switching position, in which the second switching element galvanically or electrically conductively contacts the first switching element, and a second switching position, in which the second switching element is separated from the first switching element. Each of a plurality of rod-shaped supporting elements has a first end section connected to the first base and a second end section connected to the second base. The bases and the support elements form a support cage which surrounds and supports the vacuum interrupter.

12 Claims, 3 Drawing Sheets

(58) Field of Classification Search
CPC ..... H01H 2033/6665; H01H 33/24; H01H 2033/66223
USPC ..... 218/138, 134, 139, 155
See application file for complete search history.

(56) References Cited

U.S. PATENT DOCUMENTS

| | | | | |
|---|---|---|---|---|
| 4,698,469 | A | 10/1987 | Pham et al. | |
| 5,864,108 | A * | 1/1999 | Rohling | H01H 33/666 218/134 |
| 7,115,831 | B2 | 10/2006 | Chyla et al. | |
| 7,186,942 | B1 | 3/2007 | Slade et al. | |
| 7,285,743 | B2 * | 10/2007 | Martin | H01H 33/027 218/136 |
| 10,074,496 | B2 | 9/2018 | Lamara et al. | |

FOREIGN PATENT DOCUMENTS

| | | | |
|---|---|---|---|
| DE | 8403264 | U1 | 5/1984 |
| EP | 0204180 | A1 | 12/1986 |
| EP | 1443537 | A1 | 8/2004 |
| EP | 1675143 | A1 | 6/2006 |
| FR | 2971884 | A1 | 8/2012 |
| SU | 203022 | A1 | 12/1967 |
| WO | 03071567 | A1 | 8/2003 |
| WO | 2015140674 | A1 | 9/2015 |

* cited by examiner

VACUUM SWITCH

BACKGROUND OF THE INVENTION

Field of the Invention

The invention relates to a vacuum switch.

In particular, the invention relates to vacuum switches which are in the form of outdoor switches. A vacuum switch has a vacuum interrupter in which switching elements can move relative to one another. Vacuum interrupters have a low mechanical bending resistance and therefore have to be suitably protected and supported, in particular when used in outdoor switches.

SUMMARY OF THE INVENTION

The invention is based on the object of specifying a vacuum switch which is improved, in particular, in respect of supporting the vacuum interrupter.

According to the invention, the object is achieved by the features described below.

Advantageous refinements of the invention are the subject matter of the dependent claims.

A vacuum switch according to the invention comprises two bases which are spaced apart from one another, a vacuum interrupter which is arranged between the bases and connected to the two bases, a first switching element which is arranged in the vacuum interrupter, a second switching element which can be moved between a first switching position, in which it is in electrically conductive contact with the first switching element, and a second switching position, in which it is isolated from the first switching element, and a plurality of rod-like supporting elements which each have a first end section, which is connected to a first base, and a second end section, which is connected to the second base, so that the bases and supporting elements form a supporting cage which surrounds and carries the vacuum interrupter.

The invention therefore makes provision for the vacuum interrupter to be supported by a supporting cage which is formed from the bases and the supporting elements. The supporting cage advantageously protects the vacuum interrupter against mechanical loading. As a result, a vacuum switch according to the invention is particularly advantageously suitable as an outdoor switch. Installation of the vacuum interrupter into a hollow insulator which protects it, as in the case of a large number of conventional outdoor vacuum switches, is advantageously dispensed with.

One refinement of the invention makes provision for the supporting elements to run obliquely in relation to a longitudinal axis of the vacuum interrupter. On account of supporting elements running obliquely in relation to the longitudinal axis of the vacuum interrupter, the mechanical strength of the supporting cage, which is formed by the supporting elements and bases, can advantageously be increased.

A further refinement of the invention makes provision for the supporting elements to be arranged such that they cross over. On account of supporting elements being arranged such that they cross over, the mechanical strength of the supporting cage, which is formed by the supporting elements and bases, can likewise advantageously be increased.

A further refinement of the invention makes provision for the supporting elements to be manufactured from an electrically insulating material. This advantageously prevents the supporting elements transmitting electrical voltages or currents between the bases.

A further refinement of the invention makes provision for the first base to be rigidly connected to the first switching element. As a result, the first base advantageously also acts as a carrier of the first switching element.

A further refinement of the invention makes provision for the second base to have a base cutout through which the second switching element is routed out of a gas chamber, which is surrounded by the second base, and protrudes into the vacuum interrupter. As a result, the second base advantageously also acts as a guide of the second switching element.

A further refinement of the invention makes provision for a folding bellows which is arranged in the vacuum interrupter. A first folding bellows end of the folding bellows is fastened to the second switching element. A second folding bellows end of the folding bellows is fastened to a floor of the vacuum interrupter, which floor bears against the second base, and encloses a floor cutout, which corresponds to the base cutout in the second base, in the floor of the vacuum interrupter. The folding bellows advantageously seals off the interior of the vacuum interrupter from the gas chamber.

A further refinement of the invention provides a seal which is arranged between the floor of the vacuum interrupter and the second base. The seal is, for example, a sealing ring which is inserted into a recess, which runs around the base cutout in the form of a ring, in a vacuum interrupter-side base surface of the second base. The seal advantageously seals off the region between the floor of the vacuum interrupter and the second base against gas escaping from the gas chamber.

A further refinement of the invention provides an insulating casing which sheaths the vacuum interrupter and the two bases. The insulating casing advantageously protects the vacuum switch against environmental influences, in particular when the vacuum switch is used as an outdoor switch. Since the vacuum interrupter is supported and protected by the supporting cage which is formed by the supporting elements and bases, the insulating casing does not need to perform a function which supports and protects the vacuum interrupter and can therefore be designed and configured in a relatively simple manner.

A further refinement of the invention makes provision for the supporting elements to run through the insulating casing. As a result, the insulating casing can bear directly against the vacuum interrupter, so that no additional insulating gas is required in the region around the vacuum interrupter.

A further refinement of the invention makes provision for the insulating casing to be manufactured at least predominantly from an electrically insulating material. In this case, resistively acting components and/or capacitively acting components can be added to the electrically insulating material of the insulating casing. This allows the electrical field which is generated by the vacuum switch to be influenced by adding resistively acting components and/or capacitively acting components to the electrically insulating material of the insulating casing in one region or several regions of the insulating casing.

A further refinement of the invention provides at least one control electrode which is arranged on an outer side of the vacuum interrupter or of a base. The electrical field which is generated by the vacuum switch can also advantageously be influenced in this way.

The above-described properties, features and advantages of this invention and also the way in which they are achieved will become clearer and more distinctly comprehensible in connection with the following description of exemplary embodiments which are explained in more detail in conjunction with a drawing.

DESCRIPTION OF THE INVENTION

Figure 1:
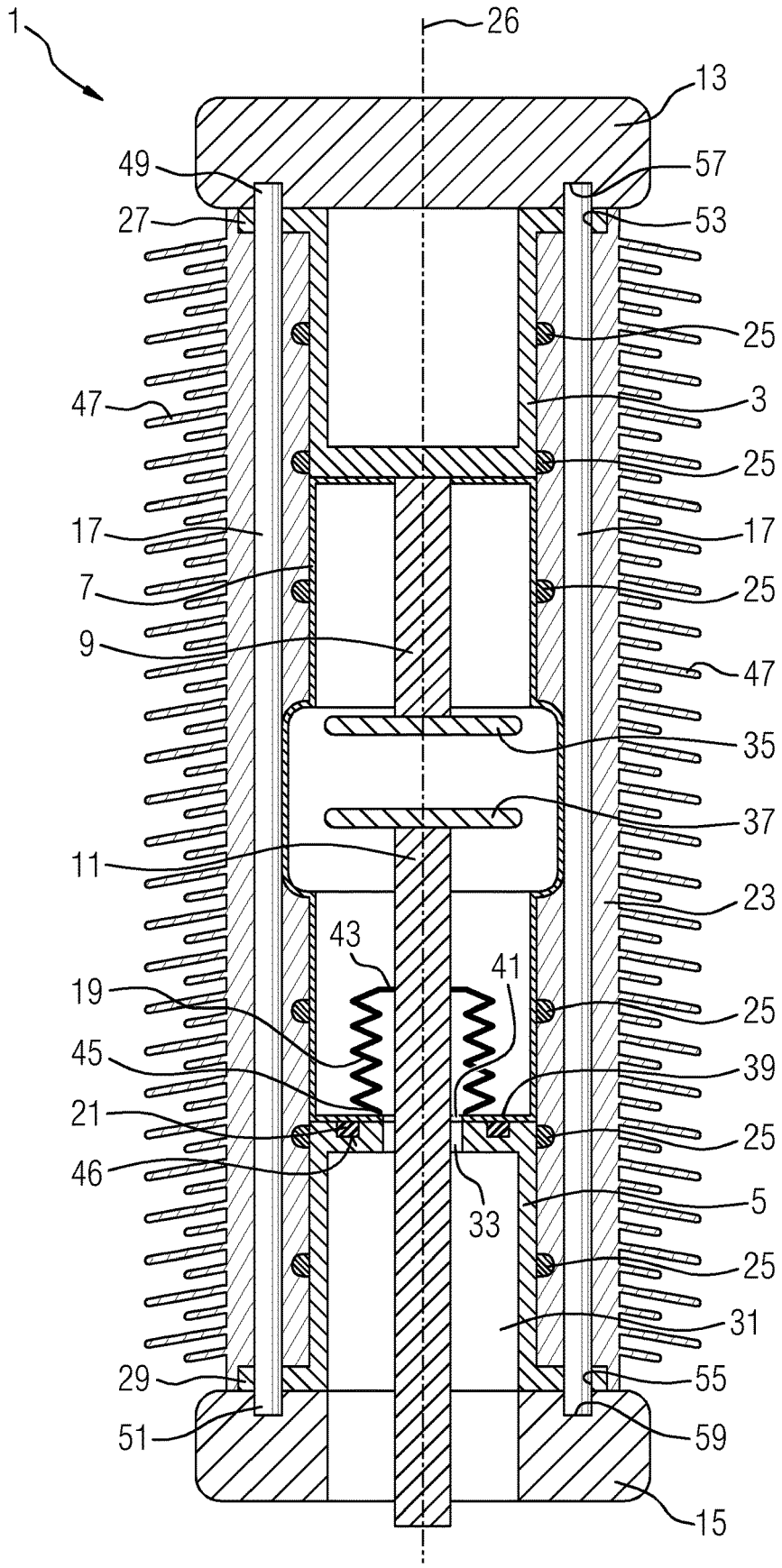
FIG. 1 shows a schematic sectional illustration of a vacuum switch.

The vacuum switch 1 comprises two bases 3, 5 which are spaced apart from one another, a vacuum interrupter 7, two switching elements 9, 11, two fastening flanges 13, 15, a plurality of rod-like supporting elements 17, a folding bellows 19, a seal 21, an insulating casing 23 and a plurality of control electrodes 25.

The vacuum interrupter 7 is arranged between the bases 3, 5 and connected to the two bases 3, 5.

Each base 3, 5 is substantially in the form of a hollow cylinder, the cylinder axis of which coincides with a longitudinal axis 26 of the vacuum switch 1 and the end of which that is averted from the vacuum interrupter 7 is open and has an outwardly projecting annular base flange 27, 29.

That end of a first base 3 which faces the vacuum interrupter 7 is of closed design. At this end, a first switching element 9, which runs along the longitudinal axis 26 in the vacuum interrupter 7, is arranged on the vacuum interrupter side.

The second base 5 surrounds a gas chamber 31. That end of the second base 5 which faces the vacuum interrupter 7 has a base cutout 33 through which a second switching element 11 is routed and protrudes out of the gas chamber 31 into the vacuum interrupter 7.

The second switching element 11 runs along the longitudinal axis 26 and can be moved between a first switching position, in which it is in electrically conductive contact with the first switching element 9, and a second switching position, in which it is isolated from the first switching element 9. The two switching elements 9, 11 have punch-like contact regions 35, 37 which face one another and bear against one another in the first switching position. The vacuum interrupter 7 is embodied to be wider in the region of the contact regions 35, 37 than in the regions which adjoin the bases 3, 5.

The vacuum interrupter 7 has a floor 39 which bears against the second base 5 and has a floor cutout 41 which corresponds to the base cutout 33 in the second base 5. The folding bellows 19 is arranged in the vacuum interrupter 7. A first folding bellows end 43 of the folding bellows 19 is fastened to the second switching element 11. A second folding bellows end 45 which is situated opposite the first folding bellows end 43 is fastened to the floor 39 of the vacuum interrupter 7 and surrounds the floor cutout 41 in the floor 39. The folding bellows 19 closes the interior of the vacuum interrupter 7 from the gas chamber 31.

The seal 21 is arranged between the floor 39 of the vacuum interrupter 7 and the second base 5 and seals off the region between the floor 39 of the vacuum interrupter 7 and the second base 5 against gas escaping from the gas chamber 31. The seal 21 is in the form of a sealing ring which is inserted into a recess 46, which runs around the base cutout 33 in the form of a ring, in a vacuum interrupter-side base surface of the second base 5.

A first fastening flange 13 is arranged on the base flange 27 of the first base 3. The second fastening flange 15 is arranged on the base flange 29 of the second base 5. The vacuum switch 1 can be connected to other components by means of the fastening flanges 13, 15.

The insulating casing 23 sheathes the vacuum interrupter 7 and the bases 3, 5. The insulating casing 23 has lamellae 47 which project outward in the manner of a shield and run, for example, around the longitudinal axis 26 in the form of a ring. The insulating casing 23 is manufactured at least predominantly from an electrically insulating material, for example from a silicone. Resistively acting components and/or capacitively acting components can be added to the electrically insulating material in one or more regions of the insulating casing 23 in order to influence an electrical field of the vacuum switch 1. By way of example, carbon can be used as a resistively acting component. By way of example, microvaristors can be used as capacitively acting components.

The control electrodes 25 are optional components of the vacuum switch 1 and each run around one of the bases 3, 5 or around the vacuum interrupter 7 in the form of a ring. The control electrodes 25 likewise serve to influence the electrical field of the vacuum switch 1.

Each supporting element 17 has a first end section 49 which is connected to the first base 3 and a second end section 51 which is connected to the second base 5. The first end section 49 runs through a flange cutout 53 in the base flange 27 of the first base 3 into a flange recess 57 in that surface of the first fastening flange 13 which faces the first base 3. The second end section 49 runs through a flange cutout 55 in the base flange 29 of the second base 5 into a flange recess 59 in that surface of the second fastening flange 15 which faces the second base 5.

Figure 2:
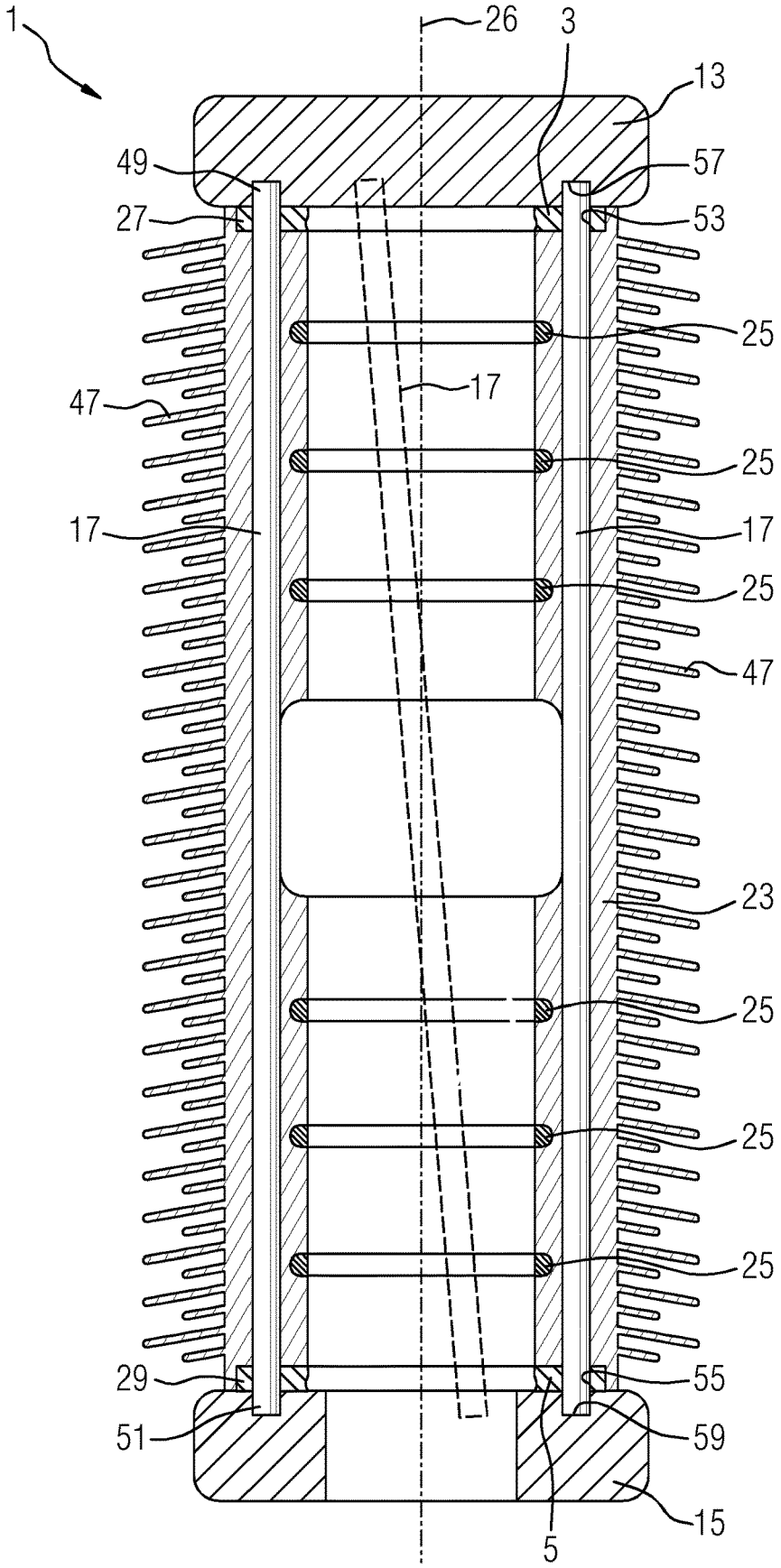
FIG. 2 shows a view similar to FIG. 1 in which the supporting elements are oriented obliquely.
Figure 3:
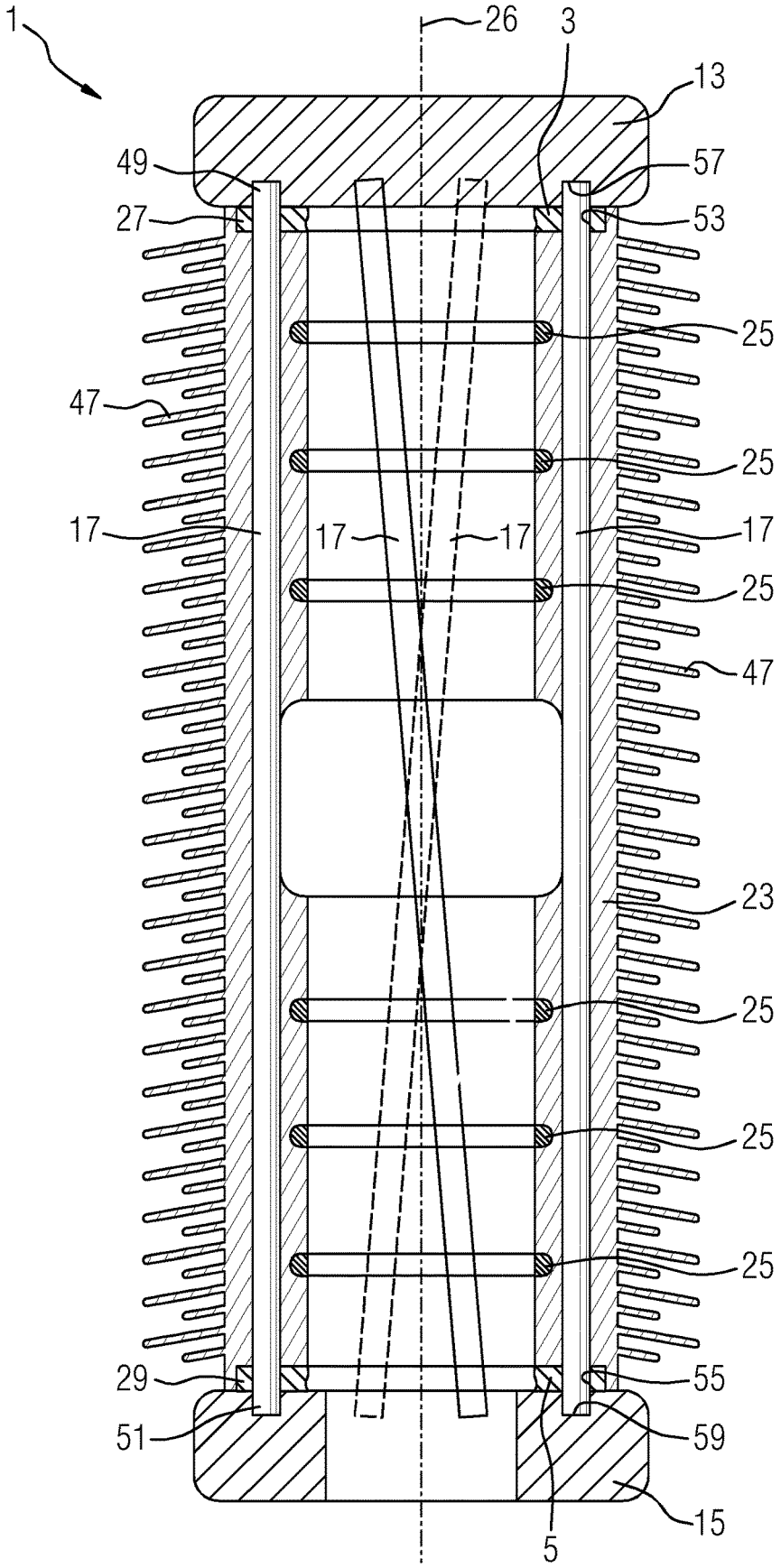
FIG. 3 shows a view similar to FIG. 1 in which the supporting elements cross over each other.

In the illustrated exemplary embodiment shown in FIG. 1, the supporting elements 17 run parallel in relation to the longitudinal axis 26. In alternative exemplary embodiments, a plurality of or all supporting elements 17 run obliquely in relation to the longitudinal axis 26 as shown in FIG. 2, wherein supporting elements 17 can be arranged, in particular, such that they cross over as shown in FIG. 3.

The supporting elements 17 are manufactured from an electrically insulating material.

By virtue of the supporting elements 17, the bases 3, 5 are braced against one another with tension and/or with pressure, so that the bases 3, 5 and supporting elements 17 form a supporting cage which surrounds and carries the vacuum interrupter 7 in a stable manner.

The supporting elements 17 run between the two bases 3, 5 through the insulating casing 23 in each case. When manufacturing the vacuum switch 1, the bases 3, 5, the vacuum interrupter 7, the supporting elements 17 and the control electrodes 25 are sheathed by the insulating casing 23 after they are connected to one another.

Even though the invention has been illustrated and described in greater detail by preferred exemplary embodiments, the invention is not limited by the examples disclosed and other variations can be derived therefrom by a person skilled in the art without departing from the scope of protection of the invention.

The invention claimed is:

1. A vacuum switch, comprising:

first and second bases being spaced apart from one another;

a vacuum interrupter disposed between said bases and connected to said bases;

a first switching element disposed in said vacuum interrupter;

a second switching element being movable between a first switching position in which said second switching element electrically conductively contacts said first switching element, and a second switching position in which second switching element is separated from said first switching element;

a plurality of rod-shaped supporting elements each having a first end section connected to said first base and a second end section connected to said second base, said supporting elements being oriented obliquely relative to a longitudinal axis of said vacuum interrupter; and said bases and said supporting elements forming a supporting cage surrounding and carrying said vacuum interrupter.

2. The vacuum switch according to claim 1, wherein said supporting elements are formed of an electrically insulating material.

3. The vacuum switch according to claim 1, wherein said first base is rigidly connected to said first switching element.

4. The vacuum switch according to claim 1, which further comprises a gas chamber surrounded by said second base, said second base having a base cutout through which said second switching element is routed out of said gas chamber and protrudes into said vacuum interrupter.

5. The vacuum switch according to claim 4, which further comprises:

a floor of said vacuum interrupter, said floor of said vacuum interrupter bearing against said second base, and said floor of said vacuum interrupter enclosing a floor cutout corresponding to said base cutout in said second base; and a folding bellows disposed in said vacuum interrupter, said folding bellows including a first folding bellows end fastened to said second switching element and a second folding bellows end fastened to said floor of said vacuum interrupter.

6. The vacuum switch according to claim 5, which further comprises a seal disposed between said floor of said vacuum interrupter and said second base.

7. The vacuum switch according to claim 6, wherein said second base includes a vacuum interrupter-side base surface having an annular recess running around said base cutout, and said seal is a sealing ring inserted into said recess.

8. The vacuum switch according to claim 1, which further comprises at least one control electrode disposed on an outer side of said vacuum interrupter or on an outer side of at least one of said bases.

9. A vacuum switch, comprising:

first and second bases being spaced apart from one another;

a vacuum interrupter disposed between said bases and connected to said bases;

a first switching element disposed in said vacuum interrupter;

a second switching element being movable between a first switching position in which said second switching element electrically conductively contacts said first switching element, and a second switching position in which second switching element is separated from said first switching element;

a plurality of rod-shaped supporting elements each having a first end section connected to said first base and a second end section connected to said second base, said supporting elements cro-p crossing over each other; and said bases and said supporting elements forming a supporting cage surrounding and carrying said vacuum interrupter.

10. A vacuum switch, comprising:

first and second bases being spaced apart from one another;

a vacuum interrupter disposed between said bases and connected to said bases:

a first switching element disposed in said vacuum interrupter;

a second switching element being movable between a first switching position in which said second switching element electrically conductively contacts said first switching element, and a second switching position in which second switching element is separated from said first switching element;

a plurality of rod-shaped supporting elements each having a first end section connected to said first base and a second end section connected to said second base:

said bases and said supporting elements forming a supporting cage surrounding and carrying said vacuum interrupter; and an insulating casing sheathing said vacuum interrupter and said bases;

said supporting elements running through said insulating casing.

11. The vacuum switch according to claim 10, wherein said insulating casing is formed at least predominantly of an electrically insulating material.

12. The vacuum switch according to claim 11, wherein said electrically insulating material of said insulating casing includes at least one of resistively acting components or capacitively acting components.

* * * * *